US008112952B2

(12) United States Patent
Shepherd

(10) Patent No.: US 8,112,952 B2
(45) Date of Patent: Feb. 14, 2012

(54) BENT POLE COMPOSITE STAIRS

(76) Inventor: John D. Shepherd, Homer Glen, IL (US)

( * ) Notice: Subject to any disclaimer, the term of this patent is extended or adjusted under 35 U.S.C. 154(b) by 386 days.

(21) Appl. No.: 12/264,658

(22) Filed: Nov. 4, 2008

(65) Prior Publication Data

US 2010/0107523 A1 May 6, 2010

(51) Int. Cl.
*E04F 11/00* (2006.01)
*E04F 19/10* (2006.01)

(52) U.S. Cl. ..... 52/187; 52/182; 52/191

(58) Field of Classification Search ..... 52/182, 52/184, 185, 187, 188, 191
See application file for complete search history.

(56) References Cited

U.S. PATENT DOCUMENTS

| | | | | |
|---|---|---|---|---|
| 1,149,689 | A * | 8/1915 | Rosner | 182/49 |
| 3,686,806 | A * | 8/1972 | Verderio | 52/187 |
| 3,740,906 | A * | 6/1973 | Schneider | 52/187 |
| 3,851,431 | A * | 12/1974 | Klein | 182/217 |
| 4,373,609 | A * | 2/1983 | De Donato | 182/178.2 |
| 5,983,580 | A * | 11/1999 | Carr | 52/187 |
| 6,516,574 | B1 * | 2/2003 | Couture | 52/182 |
| 2003/0093959 | A1 * | 5/2003 | Couture | 52/182 |

* cited by examiner

*Primary Examiner* — Eileen D Lillis
*Assistant Examiner* — Andrew Triggs
(74) *Attorney, Agent, or Firm* — Greer, Burns & Crain, Ltd.

(57) ABSTRACT

A staircase including a bent pole stringer with first and second straight stair sections separated by a spiral stair section. There is preferably a first bend defined on the stringer between the first straight stair section and the spiral stair section, and a second bend defined on the stringer between the spiral stair section and the second straight stair section. There are also a plurality of first straight stair treads cantilevered from the first straight stair section of the stringer, a plurality of spiral stair treads cantilevered from the spiral stair section of the stringer, and a plurality of second straight stair treads cantilevered from the second straight stair section of the stringer.

16 Claims, 7 Drawing Sheets

BENT POLE COMPOSITE STAIRS

The present invention relates generally to a staircase, and more particularly to a staircase with a stringer that includes a straight section extending upwardly at an oblique angle and a vertical section attached to the straight section at a bent portion. Preferably the vertical section is also attached to a second straight obliquely-angled section on its upper end at a second bent portion.

BACKGROUND

The present state of the art in stair building does not differ much from the earliest known stairs, except for the addition of different categories of stairs, such as spiral stairs. Going forward from time to time stairs have been curved, angled, and stacked. Risers have been closed, open, and cantilevered, and stringers have been single, double, cantilevered and various forms thereof. Stairs have been dramatic and plain, and they have been made of wood, stone, metal and all types of combinations of these and other materials. However all of the above known types of stairs fit one of the following categories of conventional stairs: single straight run, double run, multi-run, curved and spiral.

Single Straight Run Stairs

Single straight run stairs, which are the most basic type of conventional stairs, are the easiest to climb, and allow passing of up and down traffic at the same time. Such stairs provide the shortest access to an elevated area. In modern times, risers are usually 6.5 to 7.5 inches high and treads are usually 9.5 to 12 inches deep. For years designers have used 70 to 72 inches as a multiplier for the preferred tread and riser. That is, a stair with a 6 inch rise should have a preferred tread of near 12 inches, which is 6×12, or 72. As another example, a 4 inch rise (such as used on a sidewalk area) might have an 18 inch tread (4×18 which again equals 72). About 72 inches has been found to be a good stride for adults. However, when the stairs are mainly intended for children, the 72 value can be reduced.

Straight run stairs are usually supported at both the upper and lower ends. At the lower end, most often the first riser and stringer lower end sits on the floor or a prepared support, and at the upper end, the stringers rest against or are fastened to the opening header (much like the top of a ladder leaning against a structure). Straight stairs usually have an open area above them, and most have good clearance so carrying boxes or furniture can be easy on a straight run stairway. Some stairs that rise 8 to 10 feet have a single straight run of 12 to 18 risers. Single straight run stairs are a very efficient design for stairs. They take up the least square feet of floor space of the various conventional forms of standard straight stairs, and with the single straight run design, a user walks the least distance between floors. However, the design does not work at all locations, and there can be several issues in the single straight run design. For example, this design requires one tread space for each riser, so even a small stair that is 36 inches wide with 14 risers and 10 inch treads will need a floor space of about 36 inches×140 inches on both floors. Such a large amount of floor space between floor framing members is something that is hard to find in some structures. To create a 140 inch long opening, heavy framing is needed at the stair header and parallel to the stair. Additionally, with regard to safety, having between 12 and 18 risers in a row can increase the fall hazard, and the distance one will tumble if there is a fall is also significant.

Double-Run and Multi-Run Straight Stairs

Straight stairs can also be made to have two or more runs (i.e., called double-run stairs and multi-run stairs, respectively). While such double-run and multi-run stairs have the same traffic flow attributes as single straight run stairs, they improve on the fall issue because they can shorten the in-line riser run distance because the straight run is broken up by one or more platforms. Further, such stair designs cut the front to back depth of the floor opening down somewhat. For example, a fourteen riser stair 3 feet 0 inches wide would need 70 inches for 7 treads and 36 inches for platform depth or about 106 inches total verses 140 inches for the straight run. However, the floor space and the hole at upper floor would now be about 72 inches×106 inches on a 14 riser 36 inch wide stair when you add in the 36 inch×72 inch platform and the return run up from the platform. Double-run straight stairs also add walking distance to the straight run stair design, as distance and extra steps are needed to make the turn at the platform, because steps taken on the platform do not make any vertical progress toward the upper floor. Multi-run stairs increase the walking distance further due to the inclusion of multiple platforms. As with the standard straight run stairs, double-run and multi-run stairs usually have an open area above them, a lack of tight corners or curves, and most also have good clearance to allow the easy movement of boxes or furniture.

Additionally, due to the inclusion of the platforms on double-run and multi-run stairs, platform support is needed. This support could be in the form of walls, hangers, struts or some combination thereof. The platform becomes an intermediate floor that is used to support the upper end of the lower stringer and the lower end of the upper stringer. On some stairs, there can be several platforms between floors, all of which act as intermediate floors and all of which must be supported with hangers, struts or walls.

Spiral Stairs

Spiral stairs are often used when floor space is limited. For example, a spiral staircase with a 36 inch wide tread (72 inch diameter), only needs a 72 inch×72 inch floor space and an upper floor opening of similar size. However a 36 inch wide spiral stair tread should not be considered as being equivalent to a 36 inch tread on a single or double run straight stair. This is the case because the spiral tread is wedge-shaped, while straight stairs generally have rectangular treads. On the wedge-shaped spiral stair tread, the ideal walking line is about 16 inches from the center of the stair tread. At that location, the tread and riser are similar to the other types of stairs. When a person walks that line, risers are in the 6.5 inch to 7.5 inch range, and treads are in the 10 to 12 inch range, which is very similar to the standard stairs. However if a person walks a spiral stair on the outside near the 72 inch diameter, the risers are the same (6.5 to 7.5 inches), but the tread grows to the 14-17 inch range. This larger stride is well out of the comfort range for most adults, as it a very long stride. On the inside (i.e., near the center of the tread), the stair risers are again in the 6.5 to 7.5 inch range, but here the tread is very small, for example possibly only in the 5 to 7 inch range. Such a small range for the tread, is difficult to walk going up, and even more difficult to walk going down, as well as being dangerous.

Additionally, spiral stairs are generally very tight, so it is very difficult to carry boxes or furniture up or down a spiral staircase. The stair tends to wrap over itself, so for the first six or seven risers of a one story stair there is less than 48 inches between the hand rail and treads above. Moving anything large up or down a normal spiral staircase is a major challenge due to limited space and the tight radius. Additionally, due to the tread shape and the limited space on most spiral staircases, users walking in opposite directions will have a hard time passing each other. Thus, although spiral stairs are aesthetically pleasing and take up the least floor space of the different types of stairs, they are very impractical when high volume use is required or where product needs to be moved by stairs. Seldom will you find spiral stairs as the only stair between levels, the main exception being residential home use for access to lofts and basements where space floor space is very limited. From time to time spiral stair builders have added three or four straight run treads to the top or bottom of the standard spiral by attaching a straight stringer to the main support pole. Such a system does not include a bent pole stringer, but instead includes a main pole that extends from a starting floor to an upper floor with a secondary straight stringer attached at an angle thereto and extending to either the starting floor or the upper floor.

BRIEF SUMMARY OF THE INVENTION

The bent pole composite stair of the present invention is an improvement over prior art stair designs for many reasons. For example, unlike spiral staircases, which include a straight center pole, and conventional stairs, which use one or two stringers to get to and from a hanging platform, the staircase of the present invention uses a single bent pole structural stringer. Thus, the present invention has more overhead clearance then a typical spiral staircase, and it is easier to walk then the conventional stair. Further, unlike conventional double run stairs, embodiments of the present invention have only two attachment points for ease of installation, it needs no platform supports, and the user gains vertical distance when walking on the spiral stair treads (which replace the platform). Additionally, there is also a floor space savings, when compared to double run stairs. For example, in an embodiment with six risers in the "platform" turn, there is a savings of about 25% of floor space when compared to double run stairs. Best of all, users will walk the stair, enjoy the shortest distance between floors and never know why.

More specifically, embodiments of the present invention provide a staircase including a stringer with first and second straight stair sections separated by a spiral stair section. There is preferably a first bend defined on the stringer between the first straight stair section and the spiral stair section, and a second bend defined on the stringer between the spiral stair section and the second straight stair section. There are also a plurality of first straight stair treads cantilevered from the first straight stair section of the stringer, a plurality of spiral stair treads cantilevered from the spiral stair section of the stringer, and a plurality of second straight stair treads cantilevered from the second straight stair section of the stringer.

Embodiments of the invention also include a bent pole stringer staircase with a bent pole stringer that has a first straight portion, configured and arranged to extend upwardly at an oblique angle with respect to a horizontal surface, and a vertical portion extending vertically upwardly from a top of the first straight portion, wherein a bent portion of the bent pole stringer connects the first straight portion and the vertical portion. There are also a plurality of stair treads cantilevered from the first straight portion of the bent pole stringer as well as from the vertical portion of said bent pole stringer.

BRIEF DESCRIPTION OF THE DRAWINGS

Preferred embodiments of the present invention are described herein with reference to the drawings wherein.

DETAILED DESCRIPTION OF THE INVENTION

The bent pole composite stairway of the present invention is unlike prior art staircases, because, among other things, it uses a single structural bent pole (a stringer) attached at the lower and upper floors; it does not require two stringers like most straight run stairs; it does not have a straight support pole like most spiral stairs; and it does not have a conventional platform like most double run straight stairs. However, the stairway of the present invention does include many of the best features of prior art staircases, while eliminating many of the drawbacks.

Figure 1:
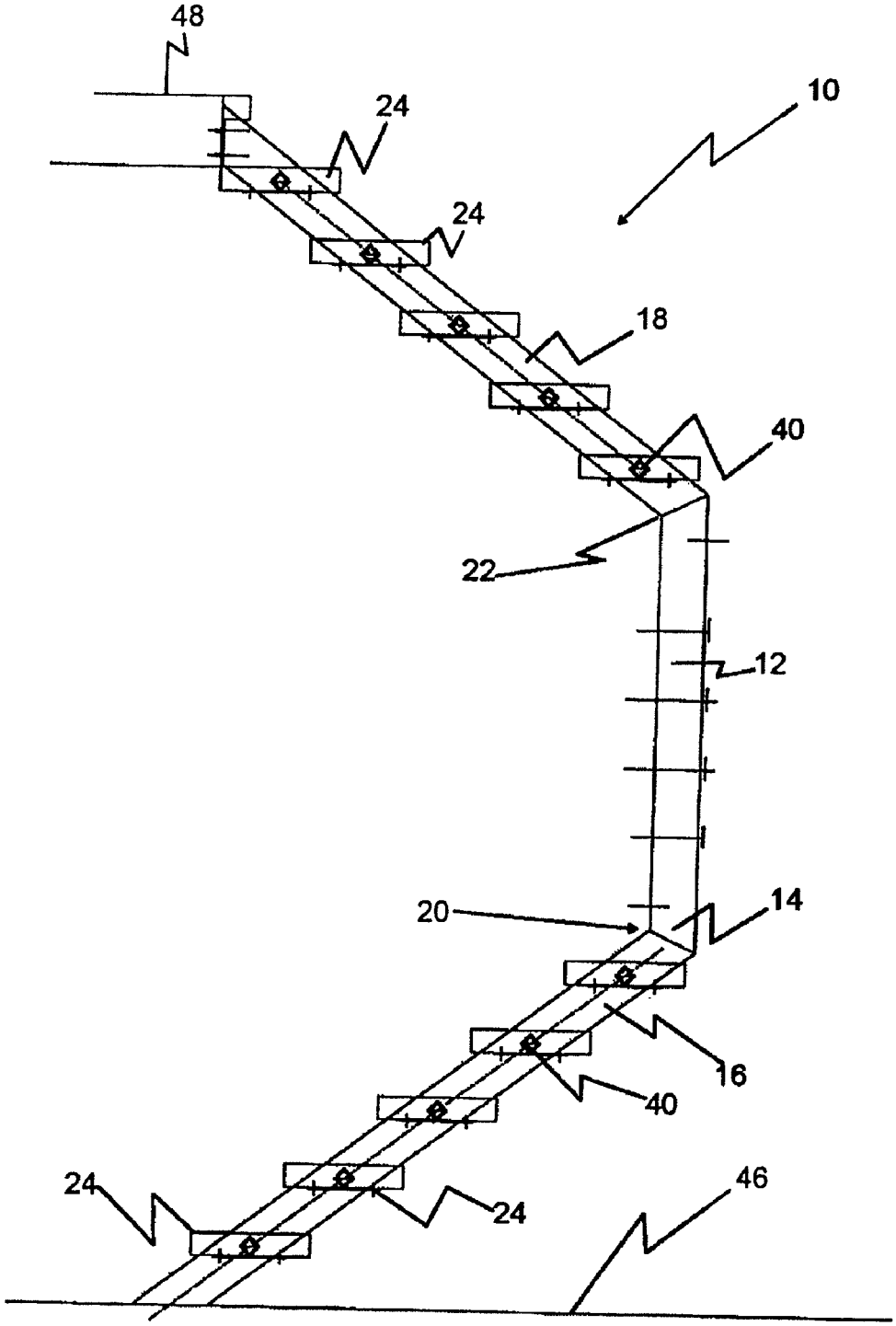
FIG. 1 is a schematic side view of one embodiment of the bent pole composite staircase of the present invention, shown without any treads on the vertical portion of the stringer.
Figure 2:
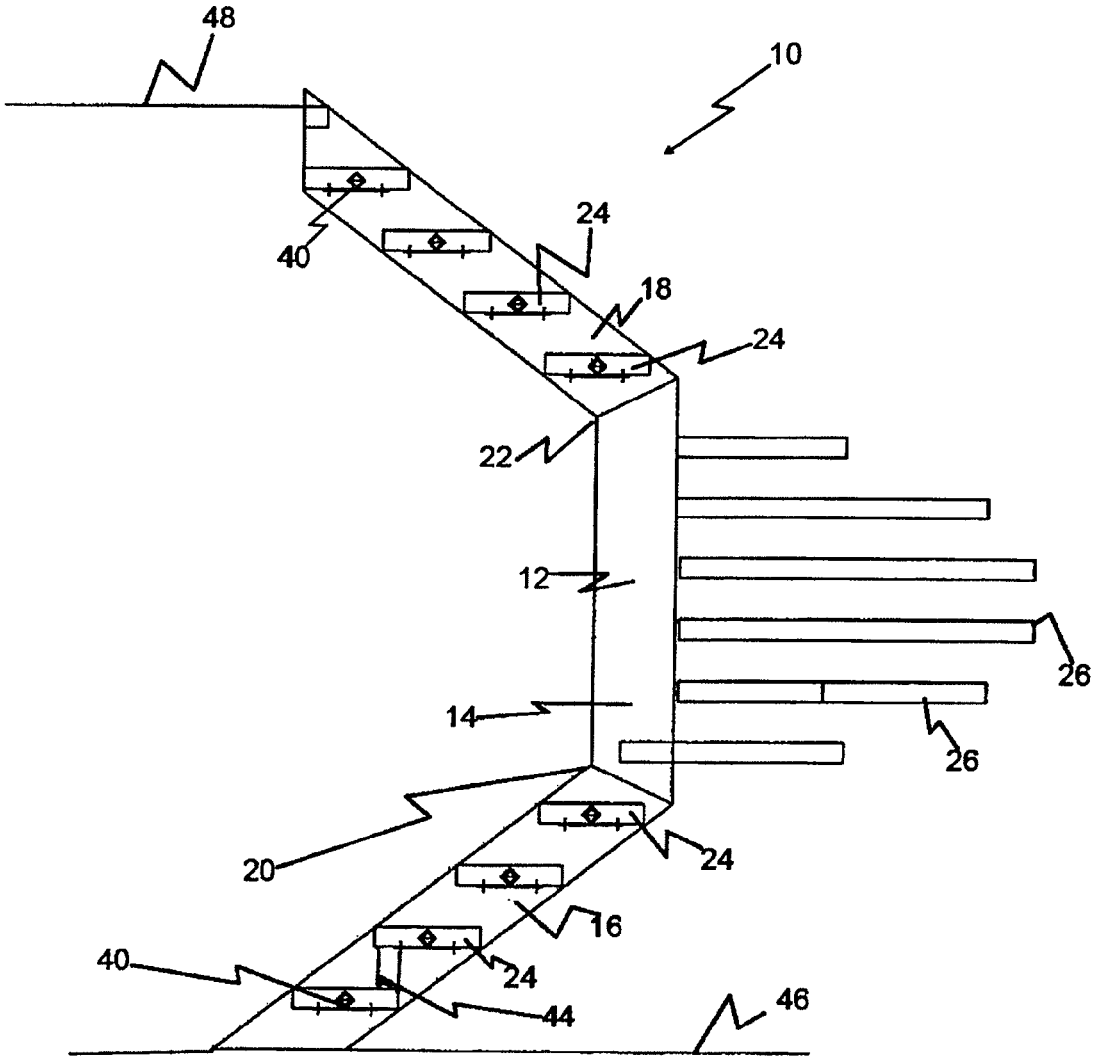
FIG. 2 is another schematic side view of the embodiment of FIG. 1, shown with treads on the vertical portion of the stringer.
Figures 3, 4, 5:
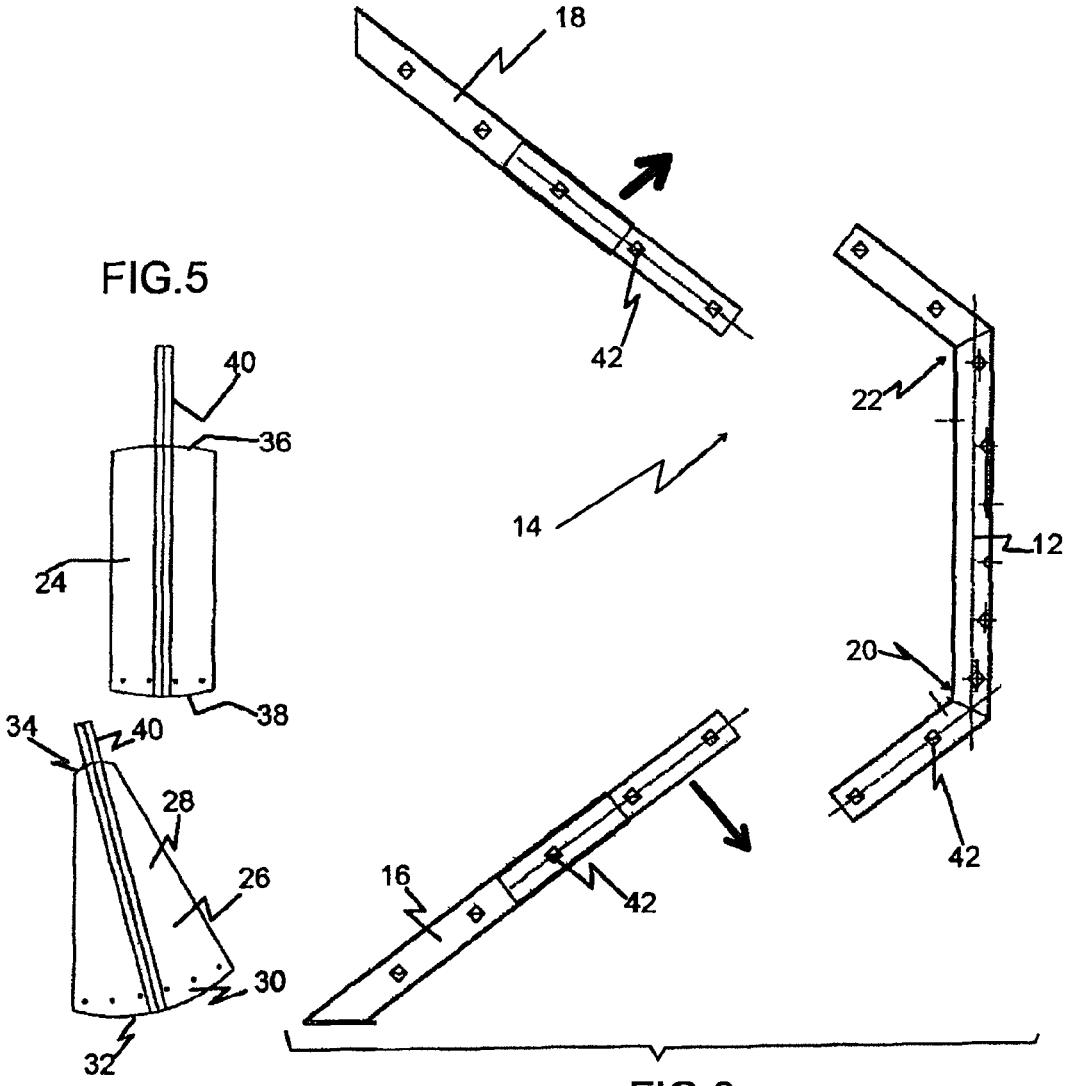
FIG. 3 is a side schematic view of the bent pole stringer of FIG. 1, shown in a partially assembled state.
FIG. 4 is a plan view of an example of a wedge-shaped tread.
FIG. 5 is a plan view of an example of a generally rectangular tread.
Figure 6:
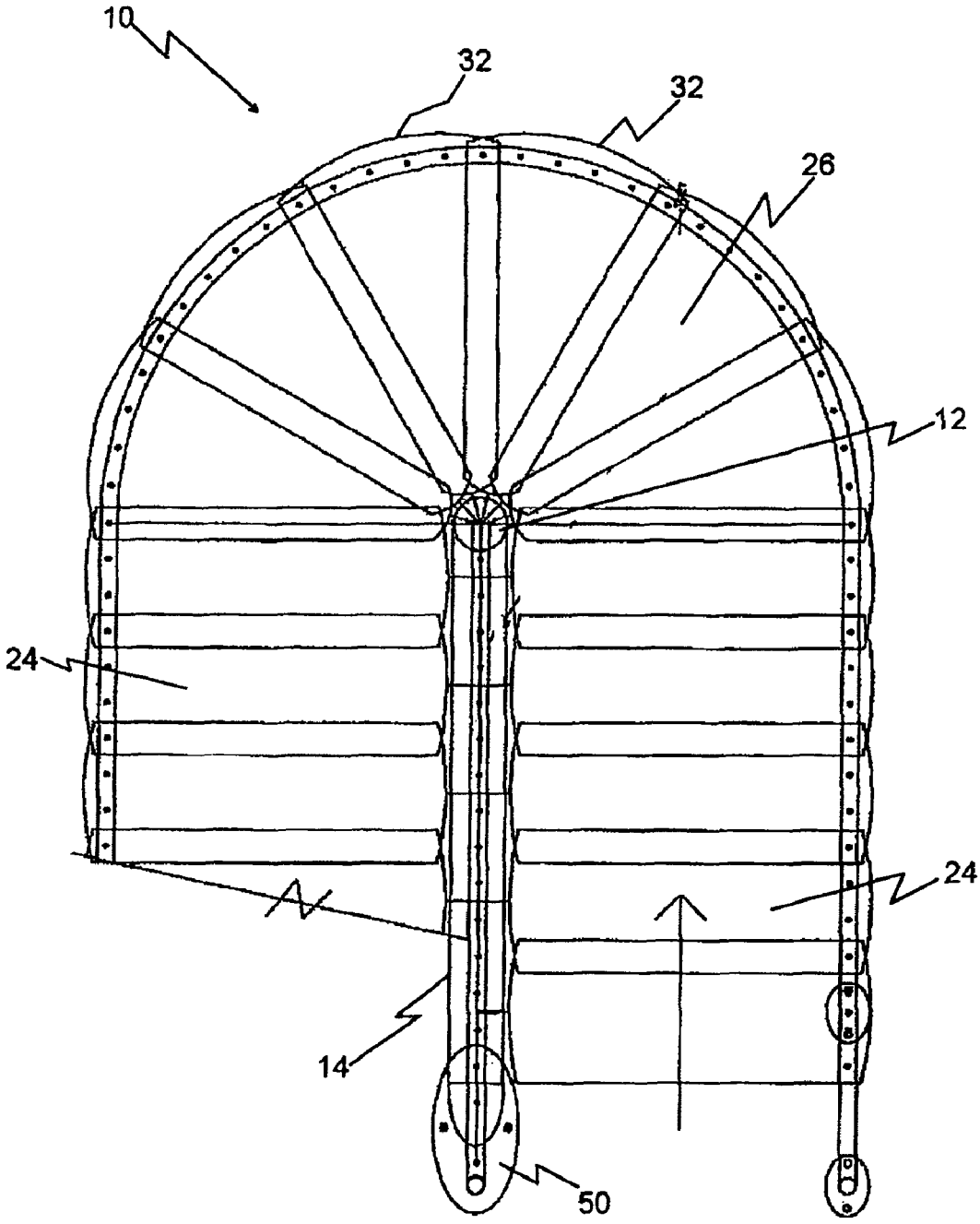
FIG. 6 is a schematic top partial view of the staircase of FIG. 1, shown going up.

Turning now to the drawings, various embodiments of the present invention are shown and will be described. First, the embodiment of FIGS. 1-7 will be described, where FIG. 1 shows a schematic side view of stairway 10, without treads on the vertical portion 12 of stringer 14 for a better view of the stringer; FIG. 2 shows a schematic side view of stairway 10, with treads on the vertical portion 12 of the stringer 14; FIG. 3 shows a schematic side view of the stringer 14 in a partially assembled state; FIGS. 4 and 5 show examples of different tread types; FIG. 6 shows a schematic of a top plan view of a portion of stairway 10 going in the up direction; and FIG. 7 shows a schematic of a top plan view of a portion of stairway 10 going in the down direction. stairway 10.

More specifically, this embodiment of staircase 10 includes a stringer 14 including a first straight stair section 16 and a second straight stair section 18 separated by a vertical portion 12, which, as described below, is the spiral stair section. There is a first bend 20 that is defined on the stringer 14 between the first straight stair section 16 and the vertical or spiral stair section 12. In this embodiment, there is also a second bend 22 that is defined on the stringer 14 between the spiral stair section 12 and the second straight stair section 18. Bends 20 and 22 each define an oblique angle between the vertical portion 12 of the stringer and the associated straight stair section 16 or 18. Such oblique angle can be in the range of about 115 to 125 degrees, for example. Viewed another way, the straight stair sections preferably extend at an angle of between about 25 to 35 degrees with respect to a horizontal line. However, there may also be situations in which extremely flat or extremely steep stairs are necessary, which could include angles as low as about 12 degrees or as high as about 55 degrees, with respect to the horizontal.

Figure 7:
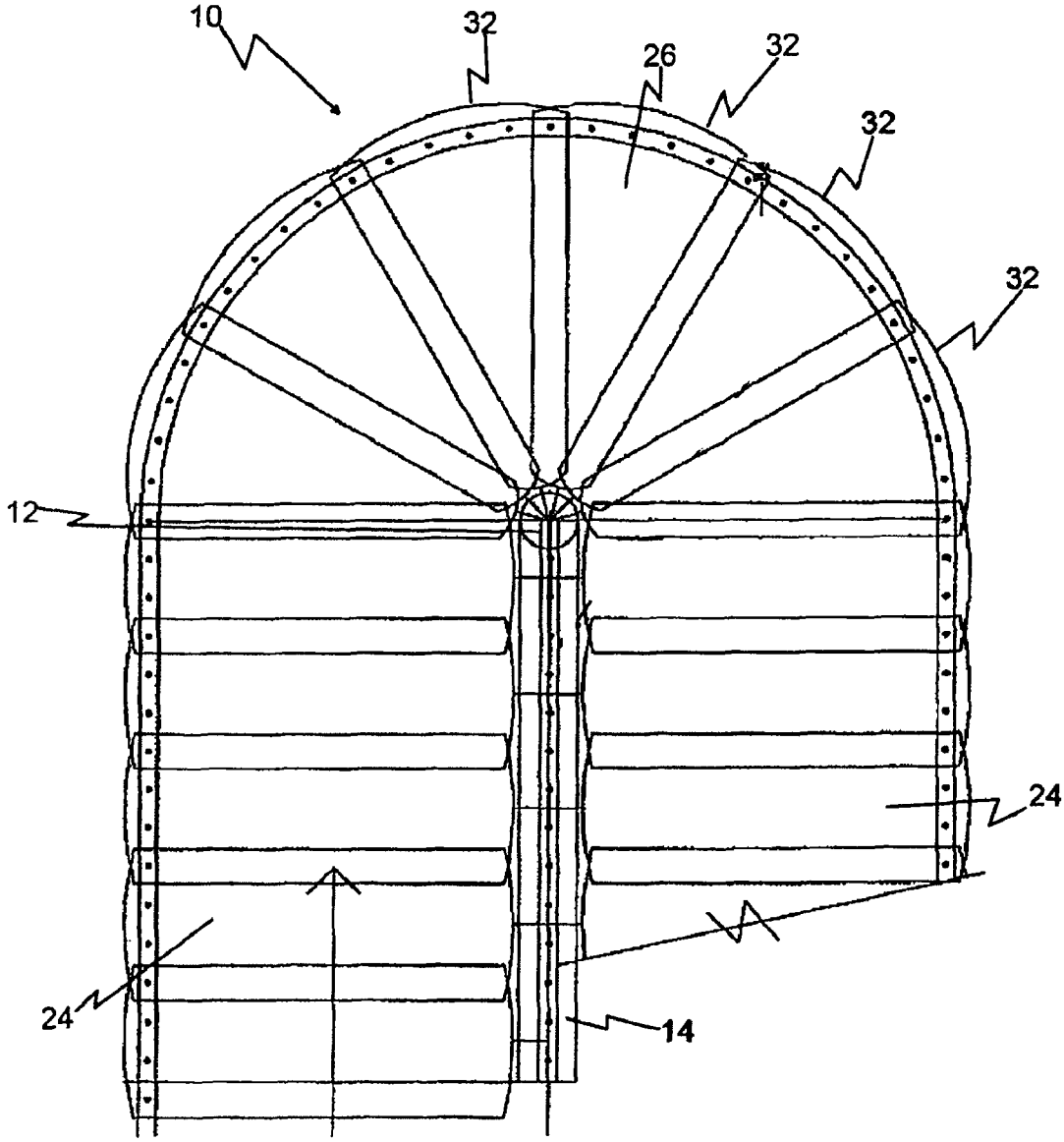
FIG. 7 is a schematic top partial view of the staircase of FIG. 1, shown going down.

As can be seen in FIGS. 2, 6 and 7, the staircase 10 includes a plurality of treads cantilevered from each of the three sections of the stringer 14. More specifically, cantilevered from straight stair sections 16 and 18 are a plurality of straight stair treads 24, and cantilevered from the spiral stair section 12

(vertical stair section) are a plurality of spiral stair treads 26. As can be seen in FIG. 2 both the straight stair treads 24 and the spiral stair treads 26 are vertically spaced from the previous tread to allow a person to walk up/down the stairs. As can be seen in FIGS. 6 and 7, when viewed in combination with FIG. 2, straight stair treads 24 are positioned to allow a straight inclined ascent/descent along the adjacent treads, and spiral stair treads 26 are positioned to allow ascent/descent along a spiral path between the first set of straight stair treads on first straight stair section 16 and the second set of straight stair treads on second straight stair section 18. As can be seen in FIGS. 6 and 7, the ascending path (FIG. 6) and the descending path (FIG. 7) of the spiral portion along spiral treads 26 is generally semicircular in plan view, in this embodiment, which results in a 180 degree turn during the spiral section. However, turns of greater than or less than 180 degrees are also contemplated as being within the scope of the invention. Further, the first run along the first straight stair section 16 and the second run along the second straight stair section 18 may be equal in length. Or they may be unequal. Still further, it is also contemplated that more than one spiral stair section 12 may be used with two or more straight stair sections. Further, it is also contemplated that only a single straight stair section could be used with a single spiral stair section, or even with two spiral stair sections (such as one on the lower end and one on the upper end).

Details of the straight and spiral treads will be discussed with reference to FIGS. 4 and 5. FIG. 4 is a plan view of one example of an embodiment of the spiral stair tread 26, showing how it is generally wedge-shaped such that it extends from a narrow portion 28 to a wide portion 30. In the preferred embodiment, the edge 32 of the wide portion 30 is curved. Accordingly, the curved sides 32 of the plurality of spiral stair treads 26 approximately resemble a semicircle, when viewed from above, as shown in FIGS. 6 and 7.

However, it is also contemplated that edge 32 may be shaped differently, such as being completely straight or formed of a plurality of adjacent straight or curved portions. In this embodiment, narrow portion edge 34 is also curved. However, as with wide portion edge 32, narrow portion edge 34 may also be configured of different shapes.

FIG. 5 is a plan view of one example of an embodiment of the straight stair tread 24. In the preferred embodiment, each of the straight stair treads 24 is of a generally rectangular shape, when viewed in plan view. Optionally, these treads 24 may include curved edges 36 and 38. However, edges of single or multiple straight portions or multiple adjacent curves are also contemplated.

In the preferred embodiment, each spiral stair tread 26 and each straight stair tread 24 includes an axially extending attachment beam 40 for attaching the tread to the stringer 12. Beam 40 may be located within the tread in the thickness direction, such as shown in FIGS. 1 and 2, or it may be positioned below the tread, with the tread being seated upon beam 40. Additionally, beam 40 preferably extends through the entire axial length of the tread 24 or 26, as shown in FIGS. 4 and 5. However, it is contemplated that beam 40 may terminate at some portion within the axial length of the tread, as long as sufficient support for the tread is provided by the beam. In the embodiment shown, beam 40 is configured to be received within a corresponding aperture 42 of stringer 14, such as shown in FIG. 3. The end of beam 40 is inserted into aperture 42, and is maintained in position by welding or bolting or other know attachment means In the preferred embodiment, beam 40 and aperture 42 have cross-sections are of the same non-circular shape, such as the square shape shown in FIG. 3, which prevents rotation of the beam within the aperture. Of course, other means of attaching the treads to the stringer are also contemplated, such as by bolting or welding without the use of beams. Additionally, although the embodiment shown does not include risers, risers may be used between each adjacent tread (such as riser 44 shown in FIG. 2). Further, treads 24 and 26 may be made from any of a number of materials, such as wood, metal or glass, or from a combination of materials (such as wood or glass within a metal frame), as long the material is of adequate strength and sufficient support is provided.

Turning now to FIG. 3, some details of the bent pole stringer 14 will be described. Stringer 14 must be of sufficient strength to carry the entire load of the stairway between floors, because, in the preferred embodiment, it is the only structural element connected to both the lower floor 46 and the upper floor 48, as shown in FIGS. 1 and 2. Accordingly, stringer 14 is preferably made of metal, although using wood of sufficient dimensions to provide the required strength is also contemplated. In order to facilitate transport, stringer 14 may be composed of multiple sections, such as the three sections (16, 12 and 18) shown in FIG. 3, where first straight stair section 16 is shown separated from vertical portion 12, and second straight stair section 18 is shown both separated from and attached to portion 12. The sections may be attached to each other by any known method, such as bolting or welding. Further, more than three sections may be utilized, or, alternatively, the stringer may be of a single, unitary element. Further, in the example embodiment, the first and second straight stair sections 16 and 18 are each made of a tube of a rectangular cross-section, while the spiral stair section 12 is made of a tube of a circular cross-section. However, alternate solid and hollow cross-sectional configurations are also contemplated as being within the scope of the invention.

The bent pole stringer 12 is one of the most important features of the present invention. As mentioned above, it starts out like a straight run stair along first straight stair section 16 with a plurality of straight stair treads 24 (such as with four cantilevered rectangular treads on a 9 foot floor height, for example). The straight stair section 16 of stringer 12, which is attached to the floor 46 using any known means (such as with plate 50), travels at a conventional stair pitch (such as, for example 7:10), then bends at the first bend 20 and turns vertical to create the spiral stair section 12, which is where the stair is similar to a spiral staircase. The desired number of spiral stair treads 26 (such as six treads, each having a 30 degree segment for the 180 degree turn shown) are cantilevered from spiral stair section 12. These spiral stair treads 26 treads are similar, in some ways to a platform of a double run straight stair because, for example, they allow a change of direction. However, unlike a platform of a double-run straight stair, while walking around the spiral stair treads, the user is ascending (or descending). Thus, the steps taken are more efficient. Attached to the upper portion of spiral stair section 12, after the second bend 22, is the second straight stair section 18. In this embodiment, the second straight stair section 18 is angled at the same oblique angle as the first straight stair section 16, but it extends directly over the first straight stair section 16 below it, and continues to the upper floor 48. The desired number of straight stair treads 24 are cantilevered from second straight stair section 18 in the same manner as first straight stair section. Although the preferred embodiment shows the second straight stair section 18 directly over the first straight stair section 16 (i.e. within the same plane), it is contemplated that the second section could be rotated so that is not co-planar with the first section. If such a change is made to the orientation of the second straight stair section 18 with respect to the first straight stair section 16, the number and angle of the spiral stair treads 26 can be modified as necessary, as well as modifying the 180 degree turn to a turn of a different angular valve.

Figure 8:
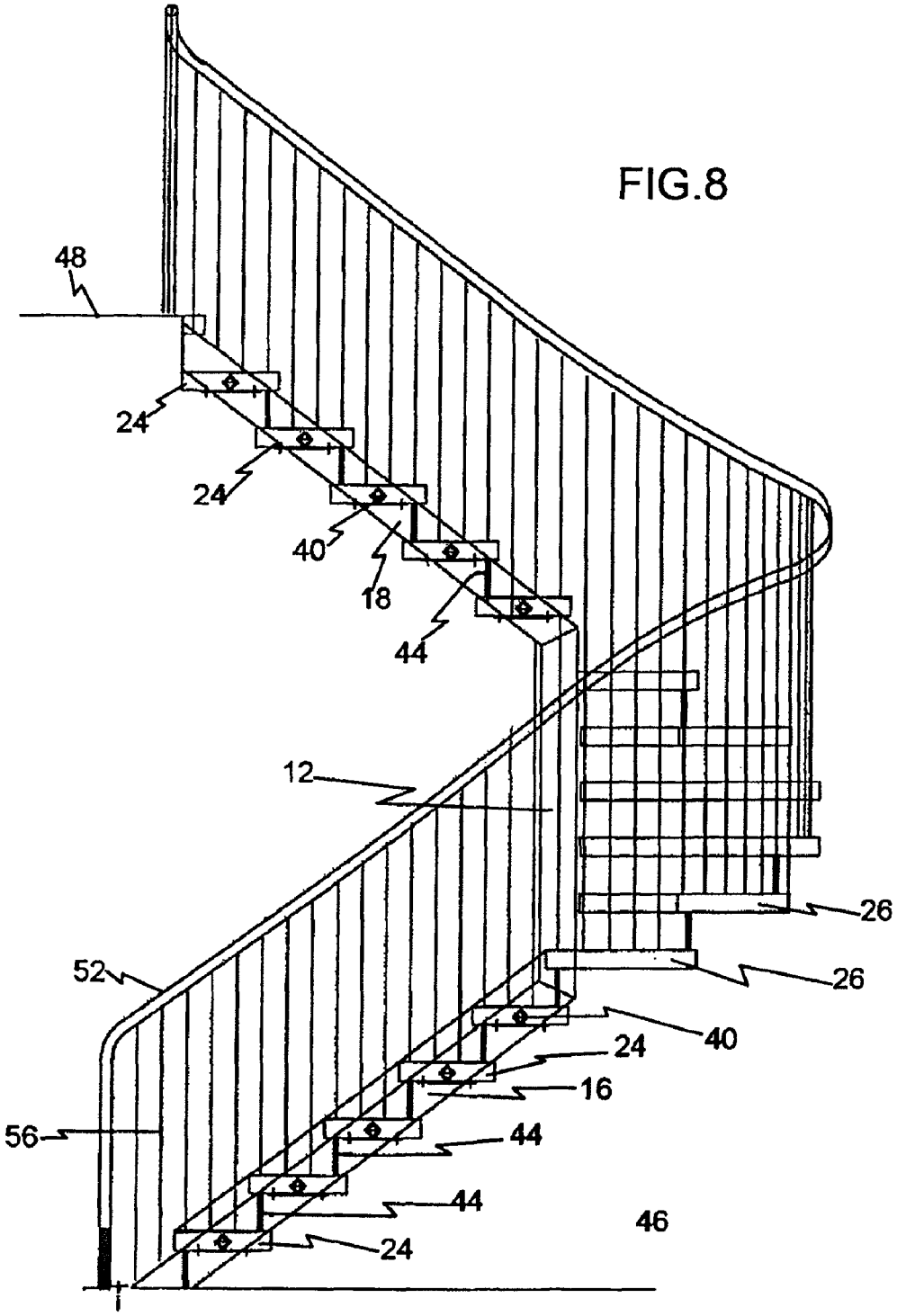
FIG. 8 is schematic side view of an embodiment including a outer railing.
Figure 9:
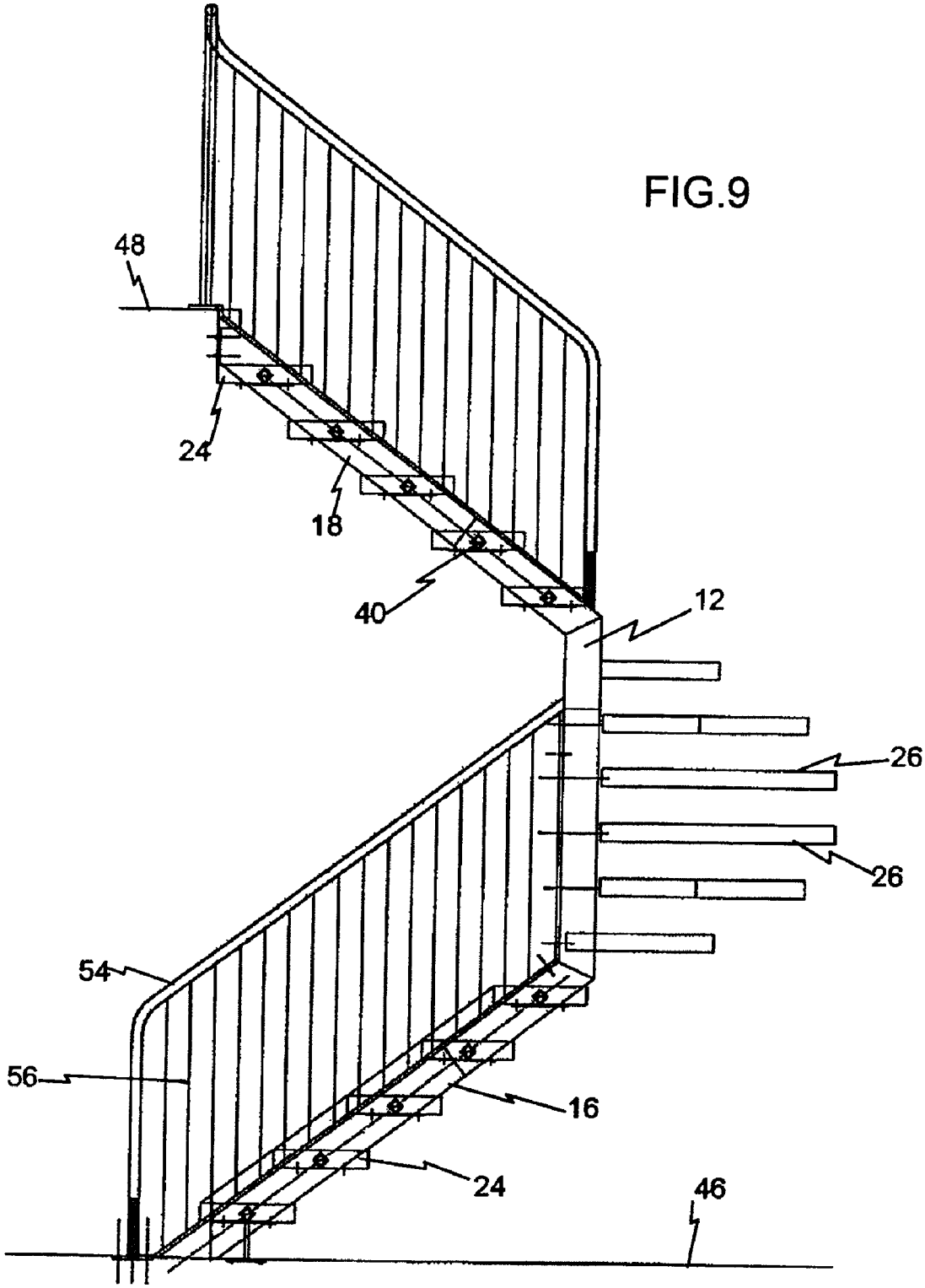
FIG. 9 is a schematic side view of an embodiment including an inner railing.

Turning now to FIGS. 8 and 9, embodiments including railings are shown. More specifically, FIG. 8 includes a railing 52 along the outer periphery, and FIG. 9 includes railing 54 along the inner periphery thereof. Railings 52 and 54 may be supported in any known manner, such as with balusters 56.

The bent pole stringer stair design of the present invention has several advantages over prior art designs, while still keeping the favorable features of the old designs. For example, similar to spiral stairs, the bent pole composite stairway of the present invention has a small foot print (for example, a 9 foot high and 6 foot wide bent pole stairway requires a 72" wide× 76" deep floor space and floor opening at the upper level, which is about the same as that sued for a 72 inch spiral staircase). Since the bent pole composite stairway of the present invention starts and ends with best part of the straight run stair (conventional treads), and then includes the best of the spiral, such as a 180 degree "platform" that rises, it is easy to have multiple users on the stair at the same time and it is easy to carry objects and furniture up the staircase. Unlike the straight double stair platform, no additional platform support is needed. And unlike the normal spiral staircase, the bent pole composite of the present invention does not have or need a post under or above the platform. Instead, the single bent pole stringer attaches to floor, carries the lower straight stair treads, the "platform" (formed by the spiral treads), and upper straight stair treads.

When one considers the walking distance between floors, the design of the present invention is extremely efficient, when compared to other stair designs, because no steps are "lost" at a platform, and there is still room for passing traffic. Unlike the spiral stairway, which is seldom used in high traffic areas, the stair of the present invention could stand alone as a full service way to move objects and to get between floors.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A staircase comprising:

a stringer including first and second straight stair sections separated by a spiral stair section, wherein a first bend is defined on said stringer between said first straight stair section and said spiral stair section and a second bend is defined on said stringer between said spiral stair section and said second straight stair section;

a plurality of first straight stair treads cantilevered from said first straight stair section of said stringer;

a plurality of spiral stair treads cantilevered from said spiral stair section of said stringer, such that said spiral stair treads are only supported by said spiral stair section of said stringer; and a plurality of second straight stair treads cantilevered from said second straight stair section of said stringer.

2. The staircase according to claim 1, wherein said first and second straight stair treads are each of a generally rectangular shape, and further wherein said spiral stair treads are each generally wedge-shaped.

3. The staircase according to claim 2, wherein said spiral stair treads each include a curved side.

4. The staircase according to claim 3, wherein said curved sides of said plurality of spiral stair treads approximately resemble a semicircle, when viewed from above.

5. The staircase according to claim 1, further comprising a plurality of risers, wherein one of said risers is located between each pair of adjacent stair treads.

6. The staircase according to claim 1, wherein said first straight stair treads are only supported by said first straight stair section of said stringer.

7. The staircase according to claim 1, wherein said second straight stair treads are only supported by said second straight stair section of said stringer.

8. The staircase according to claim 1, wherein:

said first straight stair treads are only supported by said first straight stair section of said stringer; and said second straight stair treads are only supported by said second straight stair section of said stringer.

9. A bent pole stringer staircase comprising:

a bent pole stringer including a first straight portion, configured and arranged to extend upwardly at an oblique angle with respect to a horizontal surface, and a vertical portion extending vertically upwardly from a top of said first straight portion, wherein a bent portion of said bent pole stringer connects said first straight portion and said vertical portion; and a plurality of stair treads cantilevered from said first straight portion of said bent pole stringer as well as from said vertical portion of said bent pole stringer, such that said stair treads are only supported by said bent pole stringer.

10. The bent pole stringer staircase according to claim 9, wherein there is an approximately even vertical distance between each of said stair treads.

11. The bent pole stringer staircase according to claim 9, wherein said bent pole stringer includes a second straight portion and a second bent portion, wherein said second bent portion connects an upper part of said vertical portion to a lower part of said second straight portion, and further wherein said second straight portion is configured and arranged to extend upwardly at an oblique angle with respect to a horizontal surface in a direction opposite to a direction in which said first straight portion extends.

12. The bent pole stringer staircase according to claim 11, further comprising a plurality of stair treads cantilevered from said second straight portion of said bent pole stringer.

13. The bent pole stringer staircase according to claim 12, wherein there is an approximately even vertical distance between each of said stair treads.

14. The bent pole stringer staircase according to claim 12, wherein:

said stair treads of said first and second straight portions include distal ends that are essentially straight; and said stair treads of said vertical portion include distal ends that are curved.

15. The bent pole stringer staircase according to claim 12, wherein:

said stair treads of said first and second straight portions are generally rectangular; and said stair treads of said vertical portion are generally wedge-shaped.

16. The bent pole stringer staircase according to claim 12, wherein said stair treads cantilevered from said second straight portion of said bent pole stringer are only supported by said second straight portion of said bent pole stringer.

* * * * *